US005935384A

United States Patent [19]

Taniguchi

[11] Patent Number: 5,935,384

[45] Date of Patent: Aug. 10, 1999

[54] WATER-DISINTEGRABLE PAPER HAVING MOISTURE RETAINING PROPERTY AND PROCESS FOR PRODUCING THE SAME

[75] Inventor: Kenji Taniguchi, Minamisaitama-gun, Japan

[73] Assignee: Kawano Paper Co. Ltd, Kochi, Japan

[21] Appl. No.: 08/897,653

[22] Filed: Jul. 21, 1997

[51] Int. Cl.[6] ..... D21H 21/22

[52] U.S. Cl. ..... 162/172; 162/167; 162/170; 162/173; 162/177; 162/179; 427/391; 427/411; 427/416

[58] Field of Search ..... 162/135, 158, 162/166, 167, 170, 172, 173, 177, 179; 427/391, 411, 416

[56] References Cited

U.S. PATENT DOCUMENTS

| | | | |
|---|---|---|---|
| 5,281,306 | 1/1994 | Kakiuchi et al. | 162/158 |
| 5,437,766 | 8/1995 | Van Phan et al. | 162/127 |
| 5,510,000 | 4/1996 | Phan et al. | 162/111 |
| 5,525,664 | 6/1996 | Miller et al. | 524/845 |
| 5,575,891 | 11/1996 | Trokhan et al. | 162/111 |

FOREIGN PATENT DOCUMENTS

| | | |
|---|---|---|
| A-59-144426 | 8/1984 | Japan . |
| A-62-87117 | 4/1987 | Japan . |
| A-62-135415 | 6/1987 | Japan . |
| A-62-242611 | 10/1987 | Japan . |
| A-64-83014 | 3/1989 | Japan . |
| A-4-15021 | 1/1992 | Japan . |
| A-4-325129 | 11/1992 | Japan . |

*Primary Examiner*—Blaine Copenheaver
*Attorney, Agent, or Firm*—Birch, Stewart, Kolasch & Birch, LLP

[57] ABSTRACT

A water-disintegrable paper which can be used in the same way as the ordinary toilet paper and shows excellent water disintegrability, wiping out property, feel, and moisture retaining property is provided, the water-disintegrable paper comprising: a water-disintegrable body paper; one or more components selected from glycerol, diglycerol, polyethylene glycol having an average molecular weight in a desired range, sorbitol, propylene glycol, 1,3-butylene glycol, glycine betaine, pyrrolidone carboxylic acid, pyrrolidone carboxylic acid salt, maltitol, and sodium lactate, as a humectant; and one or more components selected from sodium carboxymethylcellulose, a starch, a denatured starch, guar gum polyvinyl alcohol, and polyacrylamide, as a dry paper strength additive. The water-disintegrable paper further comprises either polyethylene glycol having an average molecular weight in a desired range or an oil substance, or both the polyethylene glycol and the oil substance in addition to the above-mentioned components. The water-disintegrable paper can be produced with a low cost, does not need any special package or wrapping and shows no decrease in the paper strength.

21 Claims, No Drawings

WATER-DISINTEGRABLE PAPER HAVING MOISTURE RETAINING PROPERTY AND PROCESS FOR PRODUCING THE SAME

BACKGROUND OF THE INVENTION

1. Field of the Invention

The present invention relates to a water-disintegrable paper and a process for producing the same, and in particular it is related to a water-disintegrable paper having moisture retaining property which is useful as a toilet paper or a sanitary paper for wiping babies' bottoms, and which can be disposed of by flushing in an ordinary water closet and the like.

2. Description of the Related Art

In the past, a flushable cleansing tissue comprising a water-disintegrable paper impregnated with cosmetic oily raw materials and a surfactant (Japanese Unexamined Patent Publication No. 59-144426), a paper product for cleaning a hemorrhoidal skin comprising a low density tissue paper treated with a softening oil agent (Japanese Unexamined Patent Publication No. 62-87117), and a skin cleansing/cleaning material comprising a water-disintegrable paper containing eucalyptus pulp which is impregnated with oil components (Japanese Unexamined Patent Publication No. 4-15021) have been introduced as a cleaning and cleansing paper product having water-disintegrability (solubility or dispersibility in water).

Also, cleaning/cleansing agent compositions having a predetermined viscosity and containing silicone oil and a lower alcohol (Japanese Unexamined Patent Publication No. 62-135415), an anal part cleaning/cleansing agent comprising an aqueous solution containing a surfactant and an alcohol as main ingredients (Japanese Unexamined Patent Publication No. 62-242611), cleaning/cleansing compositions containing polyoxyalkylene modified organopolysiloxane (Japanese Unexamined Patent Publication No. 64-83014) and other products have been known and these products have been proposed to be used by spraying them on a toilet paper or by spraying them directly on the specific part.

Furthermore, a toilet paper comprising a water-soluble paper impregnated with a liquid solution containing water or an alcohol, a perfume and a solute for disinfection such as glycerol (Japanese Unexamined Patent Publication No. 4-325129) has been known as well.

With those paper products disclosed in the publications of the above-mentioned Japanese Unexamined Patent Publication Nos. 59-144426, 62-87117, and 4-15021, the water disintegrability, the dirt wiping out property, and the skin protecting property are improved while the dry paper strength of the toilet paper, which inherently should not have wet paper strength, is prevented from being lowered. But, the above-mentioned paper products have been inconvenient as they might let hands and toilet bowls besmeared during the use, and their feel and the wiping out property have been far from the satisfactory level.

In addition, though the toilet paper impregnated with oils and the like have been accepted by those specific patients who are, for example, suffering from inflammation around the anal part, ordinary people are still reluctant to use those products, accordingly they are not yet in general use.

Those cleansing/cleaning agents disclosed in the publications of Japanese Unexamined Patent Publication Nos. 62-135415, 62-242611, and 64-83014 are used by spraying them on a toilet paper, or by spraying them directly on the anal part and the like, followed by wiping with a toilet paper. But, such a use form is complicated as it needs step-wise application, and it is particularly unsuitable for the aged and toddlers to use by themselves.

The toilet paper disclosed in the publication of Japanese Unexamined Patent Publication No. 4-325129 needs to be cased in a container made of a material having moisture-proof property so that the water-soluble paper shall not be dried by the evaporation of the solvent solution, and this leads to the increase of the production cost.

In addition, since this type of toilet paper is supposed to be used after the conventional toilet paper is used to wipe out the dirt, its use has been troublesome and time-consuming.

SUMMARY OF THE INVENTION

Therefore, an object of the present invention is to provide a water-disintegrable paper having moisture retaining property, which can be used as natural as the generally used toilet paper, and has high water disintegrability, good wiping out property, excellent feel and good skin protecting effect.

Another object of the present invention is to provide a water-disintegrable paper having moisture retaining property, which does not show decreased paper strength and does not require any special container or wrapping material, even though it is a water-disintegrable paper having moisture retaining property.

Further object of the present invention is to provide a method of producing the water-disintegrable paper having moisture retaining property, which allows the production of the above-mentioned water-disintegrable paper at a low cost.

The present inventor found out that a desired water-disintegrable paper having sufficient wiping out property, feel, paper strength, and water disintegrability can be obtained by the first method in which a predetermined dry paper strength additive is mixed with water-disintegrable paper stock (this is referred to as internal addition) and paper making process is carried out, then the body paper in the paper making process or the body paper resulting from the paper making process is impregnated with a humectant containing a moisture retaining component and a feel improving component, which is selected from water-soluble substances, or the second method in which a water-disintegrable body paper in the paper making process or a water-disintegrable body paper resulting from the paper making process is impregnated with a treatment solution in which a dry paper strength additive and a humectant are mixed.

The water-disintegrable body paper according to the present invention include a sheet material obtained from water-disintegrable natural fibers, non-natural fibers or their mixtures. Examples of the natural fibers include wood fiber and nonwood fiber such as kenaf, bagasse and bamboo, and suitable examples of non-natural fibers include rayon fiber and the like.

For impregnation of humectants and dry paper strength additives, any of the following methods can be used.

(1) If the water-disintegrable paper is still in the paper making process, the humectant and the dry paper strength additive can be sprayed using a spray and the like, after the webs are formed and while they are still wet.

(2) If the water-disintegrable paper is already made and dried, the humectant and the dry paper strength additive can be sprayed using a spray and the like or impregnated using a printing roll and the like.

The water-disintegrable paper according to the present invention can be impregnated with either a water-soluble wax or oils or both a water soluble wax and oils in addition to the above-mentioned additives, by impregnating the body paper during the paper making process or after the paper making process.

As the above-mentioned humectant, one or more components selected from glycerol, diglycerol, polyethylene glycol having an average molecular weight of at least 200 and less than 1000, sorbitol, propylene glycol, 1,3-butylene glycol, glycine betaine, pyrrolidone carboxylic acid, pyrrolidone carboxylic acid salt, maltitol, and sodium lactate, are used and it is particularly preferable to use glycerol alone or use glycerol together with sorbitol.

As the dry paper strength additive, one or more components selected from sodium carboxymethylcellulose, a starch, a denatured starch, guar gum, polyvinyl alcohol, and polyacrylamide are used and particularly preferred is sodium carboxymethylcellulose.

As the water-soluble wax, it is preferable to use polyethylene glycol having an average molecular weight of at least 1000 and up to 20000.

As the oil substance, one or more components selected from hydrocarbons such as liquid paraffin and squalane, a vegetable oil such as olive oil, camellia oil, and soya bean oil, waxes such as beeswax, carnauba wax, and lanolin, and higher alcohols such as cetanol, stearyl alcohol and oleyl alcohol are preferably used.

A preferable content of the above-mentioned humectant is in a range of from 5 to 100% by weight based on the body paper, since if the content is too little, it fails to provide sufficient moisture retaining property, on the contrary, if the content is too much, it increases the moisture content and lowers the strength.

A preferable content of the dry paper strength additive is in a range of from 0.005 to 5% by weight based on the body paper, since too much a content results in hardening the water-disintegrable paper after drying process to degrade the feel.

Furthermore, when a water-soluble wax is added together with the humectant and the dry paper strength additive, its preferable content is in the range of from 0.01 to 10% by weight based on the body paper since too little a content fails to provide sufficient wiping out property or feel, and too much a content results in lowering the paper strength.

When oils are added, a preferable content is in a range of from 0.01 to 5% by weight based on the body paper, since too little a content does not provide sufficient wiping out property or feel, and too much a content lowers the paper strength or makes the paper slippery and difficult to be wound into a reel during processing.

In particular, the water-disintegrable paper according to the present invention can be advantageously produced by impregnating the body paper resulting from the paper making process with a treatment solution obtained by mixing a chemical agent comprising 5–50 parts by weight of glycerol and 1–20 parts by weight of sorbitol as humectants, 0.01–2 parts by weight of sodium carboxymethylcellulose as a dry paper strength additive, 0.01–3 parts by weight of liquid paraffin as an oil substance and 0.05–5 parts by weight of polyethylene glycol having an average molecular weight of at least 1000 and up to 20000, as a water-soluble wax, with the same or smaller weight of water, as a dissolving aid. The amount of the impregnated treatment solution is 5–100% by weight based on the body paper resulting from the paper making process.

In such a case, when the water used as the dissolving aid exceeds 50% by weight of the total weight of the treatment solution, the body paper strength is drastically lowered due to the water content and the body paper might be broken during the impregnation process.

Also when the amount of impregnated water is larger than the amount of the water to be balanced with the moisture uptake of the humectant and the water in the ambient atmosphere, an extra drying process and the time for moisture control are further required and the production efficiency and the workability are lowered.

An antifungal agent such as parahydroxybenzoic esters can also be added to the water-disintegrable paper according to the present invention, if necessary.

As mentioned above, the water-disintegrable paper of the present invention contains the predetermined humectant and dry paper strength additive, and either the water-soluble wax or the oil substance, or both the water-soluble wax and the oil substance if necessary. Accordingly, the water-disintegrable paper of the present invention shows such a strength that can bear the use and the processing, has a moist feel, and scarcely irritates skin or mucous membrane, provides excellent wiping out property and sufficient water disintegrability.

That means, according to the present invention, the humectant contained in the body paper takes up the water in the ambient atmosphere to increase the moisture content of the body paper. The taken-up water swells the fibers, besides it works as a softening agent of the paper as it loosens the hydrogen bond between fibers. At the same time, the water works as a moistening agent to the skin and the mucous membrane of the user and gives moist and agreeable feel causing minimized irritation to the skin and the mucous membrane.

The humectant also works as a moisture retaining, protecting agent to the skin and the humectant together with the water improve the wiping out property and make the paper more flexible, thus increase the contact area and that results in further enhancement of the wiping out activity.

On the other hand, by the use of the humectant together with the dry paper strength additive, the paper strength during use can be enhanced, and the wiping out property and the feel can be simultaneously improved.

Accordingly, though the increase of the water content by the effect of the humectant loosens the hydrogen bond between the fibers and the paper strength is lowered, it improves the flexibility and the feel and as the number of the hydrogen bonds can be increased by the addition of the dry paper strength additive, the overall paper strength can be maintained or even improved.

In addition, if either the water-soluble wax or the oil substance or both of them are added during the production, the wiping out property and the feel can be further improved.

As the water-disintegrable paper of the present invention does not provide wet paper strength at all, it can be disposed of by flushing in a water closet and the like after it is used.

The water content of the water-disintegrable paper is balanced with the moisture content in the environment, the water-disintegrable paper is not dried up and an anti-drying package or wrapping is not necessary, and it can be processed and used in the same form and in the same way as those of the conventional toilet paper.

DESCRIPTION OF THE PREFERRED EMBODIMENTS

The following preferred embodiment is given to illustrate the invention.

A blended pulp comprising 80% of NBKP (needle-leaved wood bleached kraft pulp) and 20% of LBKP (broad-leaved wood bleached kraft pulp) was beaten to freeness of 620–630 ml (CSF) and used to produce a body paper for a water-disintegrable toilet paper having a basis weight of 15.5 g/m$^2$ and craping ratio of 20%.

Then the components shown in Table 1 and Table 2 were mixed and dissolved to prepare a treatment solution, which was then coated on two thicknesses of the body paper using a gravure printing roll and the body paper was impregnated with the solution. This impregnation of the body paper resulting from the paper making process with the treatment solution is referred to as external addition.

The figures in the Tables 1 and 2 are expressed as % by weight based on the pulp. As the comparative example 1 in Table 2, an ordinary toilet paper was used.

The reagents used in the Table 1 and Table are as follows;

Glycerol: "Shokuten Glycerin" Trade name, manufactured by Asahi Denka Kogyo K.K.

Sorbitol: "Sorbitol FP" Trade name, manufactured by Nikken Chemicals Co., Ltd.

Polyethylene glycol 4000: "Adeka PEG-4000" Trade name, manufactured by Asahi Denka Kogyo K.K.

Sodium carboxymethylcellulose: "Cellogen WS-C" Trade name, manufactured by Dai-ichi Kogyo Seiyaku Co., Ltd.

Polyacrylamide: "Shiryokuzai DS-415" Trade name, manufactured by Nippon PMC K.K.

Parahydroxy benzoic ester: "Neomekkinsu" Trade name, manufactured by Ueno Seiyaku K.K.

Liquid paraffin: "Cristol 70" Trade name, manufactured by Esso Sekiyu K.K.

Nonion surfactant: "Lamigen ET-70" Trade name, manufactured by Dai-ichi Kogyo Seiyaku Co., Ltd.

Epoxy type wet paper strength additive: "Shiryokuzai WS-500" Trade name, manufactured by Nippon PMC K.K.

The body paper having been subjected to the impregnation treatment with the treatment solution was allowed to stand under humidity of 65±5%, at a temperature of 20±1° C. for 20 hours and air-dried, then wound by a toilet paper winder to provide a toilet paper having a width of 114 mm, a length of 100 m and a cylindrical form (double-ply, 50 m).

The test results of the examples are given in Table 3, those of the reference examples are given in Table 4.

The details of each test item in Tables 3 and 4 are as follows.

Water content (%)

A sample having been subjected to moisture conditioning at the humidity of 65±5%, the temperature of 20±1° C. for 8 hours was measured by DC electric resistance moisture meter (Degital paper corrugated fiberboard moisture meter KG-40 manufacture by Sanko Denshi Kenkyujo K.K.).

Bursting strength (kPa)

In accordance with JIS-P8112, 10 test chips were piled and the bursting strength was measured by Mullen low-pressure type bursting strength tester. Measurement was repeated 10 times and an average thereof was obtained.

The bursting strength required for a toilet paper according to JIS (Japanese Industrial Standards) is 78 kPa or higher.

Water disintegrability

In accordance with disintegrability test of JIS-P4501, a beaker of 300 ml containing 300 ml of water (water temperature of 20±5° C.) was put on a magnetic stirrer and the rotational frequency of the rotor was set to 600±10 rpm.

Then a test chip of 114±2 mm×114±2 mm was put in the beaker and a stop watch was started. The rotational frequency of the rotor first dropped to about 500 rpm by the resistance of the test chip, then it was increased as the test chip was disintegrated. At the time when the rotational frequency was recovered to 540 rpm, the stop watch was stopped and the elapsed time was measured in seconds. The measurement was carried out 5 times and an average thereof was obtained.

According to JIS, the above-mentioned time which represents the water disintegrability of the toilet paper is required to be 100 seconds or less.

Impregnation treatment fitness

The workability of the treatment solution to be coated by a gravure printing roll was observed.

○: good x : difficult to carry out impregnation as the paper is cut due to lowered paper strength.

Processability

The workability of the toilet paper to be wound into a cylindrical form by toilet paper winder was observed.

○: good x : difficult to wind as the paper is cut due to low strength of the body paper.

Then, the toilet paper was evaluated on the softness, moistness, wiping out property, and soiling of hand and the like by organoleptic examination. The criterion for evaluation was as follows. The figures in the Tables 3 and 4 are the mean values of the scale given by 10 testers.

Soft feel

1: very soft

2: soft

3: rather soft

4: hard

Moist feel

1: very moist

2: moist

3: rather moist

4: not moist

Wiping out property

1: most excellent

2: excellent

3: ordinary

4: poor

Soil on hand

○: no soil

X: hand soiled

As it can be seen from Tables 3 and 4, each example satisfied JIS requirements on both the bursting strength and the water disintegrability and showed excellent soft feel, moist feel and wiping out property. As the example showed good workability such as the impregnation treatment fitness and the processability, it can contributes to shortening the production time and improvement of product yields.

Also, it is clear that each example does not soil the hand during use.

With the comparative examples 2, 3, and 5 in which dry paper strength additives were not used, the bursting strength was very much lowered and, particularly when liquid paraffin as an oil substance was used together with a humectant, the decrease in the strength was remarkable.

The comparative example 4 employing a body paper wherein a wet paper strength additive was internally added showed a relatively small decrease in the bursting strength and showed good wiping out property, but it had no water disintegrability.

The comparative example 6, in which no humectant was used and the treatment using liquid paraffin and a surfactant was carried out showed inferior feel and soiled hands.

The comparative example 7 having a large water content burst during the impregnation process and the coating with a gravure printing roll was hard to be carried out.

The toilet paper of each example could be processed into a cylindrical form using conventional toilet paper processing machine, but the comparative examples 2, 3, and 5 had weak paper strength and the body paper burst and the processing was difficult to be carried out.

In the above-mentioned examples, the body paper was produced and dried, then impregnated with a humectant, a dry paper strength additive and the like using a printing roll, but the production method of the present invention is not limited to this process, and the paper can be produced, dried, then impregnated with the above-mentioned agents by spraying them onto the paper using a spray and the like. If the paper is still in the production process, the agents can be sprayed for impregnation after webs are formed and while they are still wet.

In addition, dry paper strength additives can be internally added to the paper stock and paper making is carried out, then the body paper is impregnated with a humectant and the like during or after the paper making process.

As described above, according to the present invention, a water-disintegrable paper having moisture retaining property which has sufficient strength for use, and excellent properties including feel, skin protecting effect, wiping out property, water disintegrability, hygiene (free from soiling the hand), and workability during the production and the like can be produced by using a humectant together with a dry paper strength additive and, if necessary, by further using an appropriate amount of either a water-soluble wax or an oil substance, or both of them.

Accordingly, the water-disintegrable paper of the present invention when used as a toilet paper, can provide a comfortable feel even there is inflammation around the anus.

The water-disintegrable paper of the present invention, when used by babies and the aged for wiping their bottoms, can provide good feel and does not let them feel cold unlike the conventional wet tissue paper products.

Comparing to a cleansing/cleaning agent which is used by spraying onto the toilet paper, the product of the present invention can be readily used by men and women, young and old, without any inconvenience for use. The water-disintegrable paper of the present invention can also be directly disposed of by flushing in a water closet and the like due to its excellent water disintegrability.

TABLE 1

| | Example No. | | | | | | | | | |
|---|---|---|---|---|---|---|---|---|---|---|
| | 1 | 2 | 3 | 4 | 5 | 6 | 7 | 8 | 9 | 10 |
| Glycerol | 20 | 20 | 20 | 20 | 10 | 10 | 10 | 10 | 10 | 30 |
| Sorbitol | 0 | 0 | 0 | 0 | 5 | 5 | 5 | 5 | 5 | 0 |
| Polyethylene glycol 4000 | 0 | 0.5 | 0 | 0.4 | 0 | 0 | 1 | 0 | 0.5 | 0 |
| Liquid paraffin | 0 | 0 | 0.2 | 0.1 | 0 | 0 | 0 | 0.5 | 0.5 | 0 |
| Nonion surfactant | 0 | 0 | 0.02 | 0.01 | 0 | 0 | 0 | 0.05 | 0.05 | 0 |
| Sodium carboxymethylcellulose | 0.1 | 0.1 | 0.1 | 0.1 | 0.1 | 0 | 0.1 | 0.2 | 0.2 | 1 |
| Polyacrylamide | 0 | 0 | 0 | 0 | 0 | 0.1 | 0 | 0 | 0 | 0 |
| Parahydroxy benzoic ester | 0 | 0 | 0 | 0 | 0.01 | 0.01 | 0.01 | 0.01 | 0.01 | 0.01 |
| Water | 10 | 10 | 10 | 10 | 6 | 6 | 6 | 8 | 8 | 15 |

TABLE 2

| | Comparative Example No. | | | | | | |
|---|---|---|---|---|---|---|---|
| | 1 | 2 | 3 | 4 | 5 | 6 | 7 |
| Glycerol | 0 | 10 | 10 | 10 | 30 | 0 | 20 |
| Sorbitol | 0 | 5 | 5 | 5 | 0 | 0 | 0 |
| Liquid paraffin | 0 | 0 | 2 | 2 | 0 | 20 | 0 |
| Nonion surfactant | 0 | 0 | 0.2 | 0.2 | 0 | 2 | 0 |
| Epoxy type wet paper strength additive (internally added) | 0 | 0 | 0 | 0.2 | 0 | 0 | 0 |
| Parahydroxy benzoic ester | 0 | 0.01 | 0.01 | 0.01 | 0.01 | 0 | 0.01 |
| Water | 0 | 6 | 6 | 6 | 15 | 0 | 30 |

TABLE 3

| | Example No. | | | | | | | | | |
|---|---|---|---|---|---|---|---|---|---|---|
| | 1 | 2 | 3 | 4 | 5 | 6 | 7 | 8 | 9 | 10 |
| Water content (%) | 14.0 | 14.1 | 13.8 | 13.9 | 12.2 | 12.3 | 12.6 | 12.2 | 12.2 | 15.3 |
| Bursting strength (kPa) | 132 | 125 | 101 | 97 | 144 | 154 | 103 | 143 | 129 | 380 |
| Water disintegrability (sec) | 18 | 23 | 23 | 20 | 20 | 18 | 22 | 35 | 29 | 24 |
| Impregnation treatment fitness | ○ | ○ | ○ | ○ | ○ | ○ | ○ | ○ | ○ | ○ |
| Processability | ○ | ○ | ○ | ○ | ○ | ○ | ○ | ○ | ○ | ○ |
| Soft feel | 2.0 | 1.5 | 1.4 | 1.2 | 1.8 | 1.9 | 1.2 | 1.2 | 1.1 | 2.7 |
| Moist feel | 1.4 | 1.3 | 1.4 | 1.3 | 1.6 | 1.6 | 1.4 | 1.5 | 1.3 | 1.0 |

TABLE 3-continued

| | Example No. | | | | | | | | | |
|---|---|---|---|---|---|---|---|---|---|---|
| | 1 | 2 | 3 | 4 | 5 | 6 | 7 | 8 | 9 | 10 |
| Wiping out property | 1.5 | 1.2 | 1.3 | 1.2 | 1.4 | 1.5 | 1.1 | 1.3 | 1.1 | 1.9 |
| Soil on hand | ○ | ○ | ○ | ○ | ○ | ○ | ○ | ○ | ○ | ○ |

TABLE 4

| | Comparative Example No. | | | | | | |
|---|---|---|---|---|---|---|---|
| | 1 | 2 | 3 | 4 | 5 | 6 | 7 |
| Water content (%) | 7.2 | 12.0 | 11.7 | 11.9 | 15.2 | 7.0 | — |
| Bursting strength (kPa) | 120 | 67 | 50 | 76 | 38 | 106 | — |
| Water disintegrability (sec) | 22 | 19 | 17 | 1000 or more | 13 | 32 | — |
| Impregnation treatment fitness | — | ○ | ○ | ○ | ○ | ○ | x |
| Processability | ○ | x | x | ○ | x | ○ | — |
| Soft feel | 4.0 | 1.4 | 1.4 | 1.5 | 1.3 | 3.2 | — |
| Moist feel | 4.0 | 1.6 | 1.8 | 1.7 | 1.0 | 4.0 | — |
| Wiping out property | 3.0 | 2.5 | 2.8 | 1.8 | 3.3 | 2.6 | — |
| Soil on hand | ○ | ○ | ○ | ○ | ○ | x | — |

What is claimed is:

1. A water-disintegrable paper having a moisture retaining property comprising a water-disintegrable body paper;

at least one component selected from glycerol, diglycerol, polyethylene glycol having an average molecular weight of at least 200 and less than 1000, sorbitol, propylene glycol, 1,3-butylene glycol, glycine betaine, pyrrolidone carboxylic acid, pyrrolidone carboxylic acid salt, maltitol, and sodium lactate;

at least one component selected from sodium carboxymethylcellulose, a starch, a denatured starch, guar gum, polyvinyl alcohol, and polyacrylamide; and polyethylene glycol having an average molecular weight of 1000 to 20,000.

2. A water-disintegrable paper having a moisture retaining property according to claim 1, which further comprises an oil substance, wherein the oil substance comprises at least one component selected from a hydrocarbon, a vegetable oil, a wax and a higher alcohol.

3. A water-disintegrable paper having a moisture retaining property according to claim 2, wherein glycerol is present in an amount of 5–100% of the weight of the body paper;

sodium carboxymethylcellulose is present in an amount of 0.005–5% of the weight of the body paper; and the oil substance is present in an amount of 0.01–5% of the weight of the body paper.

4. A water-disintegrable paper having moisture retaining property according to claim 3, wherein the oil substance is liquid paraffin.

5. A water-disintegrable paper having a moisture retaining property according to claim 2, wherein glycerol is present in an amount of 5–100% of the weight of the body paper;

sodium carboxymethylcellulose is present in an amount of 0.005–5% of the weight of the body paper;

polyethylene glycol having an average molecular weight of 1,000 to 20,000 is present in an amount of 0.01–10% of the weight of the body paper; and the oil substance is present in an amount of 0.01–5% of the weight of the body paper.

6. A water-disintegrable paper having moisture retaining property according to claim 5, wherein the oil substance is liquid paraffin.

7. A water-disintegrable paper having a moisture retaining property according to claim 2, wherein a mixture of glycerol and sorbitol is present in an amount of 5–100% of the weight of the body paper;

sodium carboxymethylcellulose is present in an amount of 0.005–5% of the weight of the body paper; and the oil substance is liquid paraffin and is present in an amount of 0.01–5% of the weight of the body paper.

8. A water-disintegrable paper having moisture retaining property according to claim 2, wherein a mixture of glycerol and sorbitol is present in an amount of 5–100% of the weight of the body paper;

sodium carboxymethylcellulose is present in an amount of 0.005–5% of the weight of the body paper;

polyethylene glycol having an average molecular weight of at least 1,000 to 20,000 is present in an amount of 0.01–10% of the weight of the body paper; and the oil substance is liquid paraffin and is present in an amount of 0.01–5% of the weight of the body paper.

9. A water-disintegrable paper having a moisture retaining property according to claim 2, wherein the hydrocarbon is liquid paraffin or squalene, wherein the vegetable oil is olive oil, camellia oil or soybean oil, wherein the wax is beeswax, carnauba wax or lanolin and wherein the higher alcohol is cetanol, stearyl alcohol or oleyl alcohol.

10. A water-disintegrable paper having a moisture retaining property according to claim 1, wherein glycerol is present in an amount of 5–100% of the weight of the body paper;

sodium carboxymethylcellulose is present in an amount of 0.005–5% of the weight of the body paper; and polyethylene glycol having an average molecular weight of 1000 to 20,000 is present in an amount of 0.01–10% of the weight of the body paper.

11. A water-disintegrable paper having a moisture retaining property according to claim 1, wherein a mixture of glycerol and sorbitol is present in an amount of 5–100% of the weight of the body paper;

sodium carboxymethylcellulose is present in an amount of 0.005–5% of the weight of the body paper; and polyethylene glycol having an average molecular weight of 1000 to 20,000 is present in an amount of 0.01–10% of the weight of the body paper.

12. A water-disintegrable paper having a moisture retaining property according to claim 1, wherein glycerol and sorbitol are present in a ratio of two parts glycerol to one part sorbitol.

13. A water-disintegrable paper having a moisture retaining property according to claim 1, wherein glycerol and sorbitol are both present, wherein the polyethylene glycol has a molecular weight of 4000 and wherein the ratio of glycerol to sorbitol to polyethylene glycol is 10:5:1.

14. A process for producing a water-disintegrable paper comprising;

mixing one or more components selected from sodium carboxymethylcellulose, a starch, a denatured starch, guar gum, polyvinyl alcohol, and polyacrylamide with a water-disintegrable paper stock; performing a paper making process; and impregnating a body paper resulting from the paper making process with a treatment solution comprising (i) at least one component selected from glycerol, diglycerol, polyethylene glycol having an average molecular weight of at least 200 and less than 1000, sorbitol, propylene glycol, 1,3-butylene glycol, glycine betaine, pyrrolidone carboxylic acid, pyrrolidone carboxylic acid salt, maltitol, and sodium lactate and (ii) polyethylene glycol having an average molecular weight of 1000 to 20,000.

15. A process for producing a water-disintegrable paper according to claim 14, wherein said treatment solution further comprises (iii) liquid paraffin.

16. A water-disintegrable paper produced by the process of claim 15.

17. A water-disintegrable paper produced by the process of claim 14.

18. A process for producing a water-disintegrable paper comprising impregnating a body paper resulting from a paper making process with a treatment solution comprising;

(i) at least one component selected from glycerol, diglycerol, polyethylene glycol having an average molecular weight of at least 200 and less than 1,000, sorbitol, propylene glycol, 1,3-butylene glycol, glycine betaine, pyrrolidone carboxylic acid, pyrrolidone carboxylic acid salt, maltitol, and sodium lactate and (ii) at least one component selected from sodium carboxymethylcellulose, a starch, a denatured starch, guar gum, polyvinyl alcohol, and polyacrylamide and (iii) polyethylene glycol having an average molecular weight of 1,000 to 20,000.

19. A process for producing a water-distinegrable paper according to claim 18, wherein said solution further comprises (iv) liquid paraffin.

20. A water-disintegrable paper produced by the process of claim 19.

21. A water-disintegrable paper produced by the process of claim 18.

* * * * *